US009278269B2

(12) United States Patent
Chen

(10) Patent No.: US 9,278,269 B2
(45) Date of Patent: Mar. 8, 2016

(54) TOY BAT AND PROJECTILE LAUNCHER

(71) Applicant: Shaoyun Chen, Shantou (CN)

(72) Inventor: Shaoyun Chen, Shantou (CN)

( * ) Notice: Subject to any disclaimer, the term of this patent is extended or adjusted under 35 U.S.C. 154(b) by 99 days.

(21) Appl. No.: 13/964,077

(22) Filed: Aug. 10, 2013

(65) Prior Publication Data

US 2015/0045155 A1 Feb. 12, 2015

(51) Int. Cl.

| | |
|---|---|
| ***A63B 59/02*** | (2006.01) |
| ***F41B 7/00*** | (2006.01) |
| ***A63B 69/00*** | (2006.01) |
| ***A63B 59/00*** | (2015.01) |
| *A63B 65/12* | (2006.01) |
| *A63B 69/40* | (2006.01) |

(52) U.S. Cl.

CPC ..... *A63B 59/0066* (2013.01); *A63B 59/02* (2013.01); *A63B 65/122* (2013.01); *A63B 65/125* (2013.01); *A63B 69/409* (2013.01); *A63B 2069/0008* (2013.01); *A63B 2243/0004* (2013.01); *F41B 7/00* (2013.01)

(58) Field of Classification Search

CPC ..... A63B 67/22; A63B 59/0066; A63B 69/0002; A63B 59/02; A63B 65/125; A63B 65/122; F41B 7/00

USPC ..... 473/457, 22, 431, 564, 422, 511, 507, 473/510; 124/16, 5, 65, 63

See application file for complete search history.

(56) References Cited

U.S. PATENT DOCUMENTS

| | | | | | |
|---|---|---|---|---|---|
| 73,006 | A * | 1/1868 | Hawkins | A63B 65/125 | 473/511 |
| 163,294 | A * | 5/1875 | Bass | 473/507 | |
| 721,953 | A * | 3/1903 | Holmstrom | A63B 59/02 | 473/510 |
| 1,034,716 | A * | 8/1912 | Kruger | A63B 65/125 | 473/511 |
| 1,210,847 | A * | 1/1917 | Rubel | A63B 65/125 | 473/511 |
| 2,600,883 | A * | 6/1952 | King | F41B 7/00 | 124/16 |
| 2,772,887 | A * | 12/1956 | Blake | 473/457 | |
| 3,111,314 | A * | 11/1963 | Topper | 473/457 | |
| 3,115,342 | A | 12/1963 | Webster | | |
| 3,120,387 | A * | 2/1964 | Weinstein | 473/457 | |
| 3,236,521 | A * | 2/1966 | Knott | 473/457 | |
| 3,819,179 | A | 6/1974 | Ambler, Jr. et al. | | |
| 3,897,061 | A * | 7/1975 | Grattan | 473/511 | |
| 4,521,015 | A | 6/1985 | Carafeno | | |
| 4,892,081 | A * | 1/1990 | Moormann | 124/65 | |
| 5,115,794 | A * | 5/1992 | Moormann | F41B 11/641 | 124/65 |
| 5,141,236 | A * | 8/1992 | Petitto | A63B 65/122 | 473/511 |
| 5,292,134 | A * | 3/1994 | Schlundt | A63B 65/122 | 124/65 |
| 5,522,372 | A * | 6/1996 | Gerstikov | 473/564 | |
| 6,241,629 | B1 * | 6/2001 | Otto | 473/457 | |
| 7,938,110 | B2 * | 5/2011 | Udwin | 124/65 | |
| 2002/0137581 | A1 * | 9/2002 | Wang | 473/457 | |

* cited by examiner

*Primary Examiner* — Mitra Aryanpour

(74) *Attorney, Agent, or Firm* — LaMorte & Associates, P.C.

(57) ABSTRACT

A toy assembly that includes a bat structure and balls. The bat structure can be used to bat a ball like a traditional baseball bat. The bat structure can also be loaded with a ball, wherein the bat structure can launch the ball pneumatically. The bat structure has a cylindrical section. A piston head is disposed within the cylindrical section. A ball retention ring is coupled to the end of the cylindrical section. A tapered section of the bat structure is coupled to the opposite end of the cylindrical section. A handle is attached to the tapered section using a mechanical connector. A piston rod is coupled to both the handle and the piston head. A ball is set into the ball retaining ring. The piston head can then be advanced within the bat structure. This creates high pressure that eventually launches the ball.

15 Claims, 4 Drawing Sheets

TOY BAT AND PROJECTILE LAUNCHER

BACKGROUND OF THE INVENTION

1. Field of the Invention

In general, the present invention relates to toy projectile launching devices that utilize pneumatic force to propel a projectile into the air. More particularly, the present invention relates to elongated pneumatic launchers that can also be used as a bat for batting balls when not used as a launcher.

2. Prior Art Description

In the toy industry, there have been many toy launching devices that are used to launch a toy ball into the air. Likewise, there have been a large number of specialized toy bats used to strike balls. In fact, in the toy industry, it is not uncommon for both types of toys to be combined.

In the prior art, baseball bats have been invented with hollow interiors that are designed to hold and toss various balls. Such toy bats toss a ball out of an opening at the top of the bat as the bat is swung. Prior art toy baseball bats of this type are exemplified by U.S. Pat. No. 5,522,372 to Gerstikov, entitled Ball Throwing Device.

In addition to toy bats that are designed to toss balls long distances, many toy bats have been designed to toss a ball only a short distance into the air. In this manner, the bat can be used to strike the ball that just exited the bat. Typically, such prior art bats contain trigger devices that control the release of the ball. In this manner, balls stored inside the bat do not fall out as the bat is swung. Such prior art toy bats are exemplified by U.S. Pat. No. 3,115,342 to Webster, entitled Combined Bat And Ball Magazine; U.S. Pat. No. 4,521,015 to Carafeno, entitled Toy Baseball Bat Device; U.S. Pat. No. 3,111,314 to Topper, entitled Toy Fungo Bat; and U.S. Pat. No. 3,819,179 to Ambler, entitled Ball Bat.

The present invention is a toy assembly that has a physical structure that enables it to be selectively configured either as a bat for batting balls or as a ball launcher that launches balls using pneumatic force. The toy can be quickly converted by a child using a simple mechanical manipulation of the toy's handle. The details of the present invention are described and claimed below.

SUMMARY OF THE INVENTION

The present invention is a toy assembly that includes a bat structure and balls. The bat structure can be used to bat a ball like a traditional baseball bat. However, the bat structure can also be loaded with a ball, wherein the bat structure can launch the ball pneumatically.

The bat structure has a cylindrical section that extends between a first end and a second end. A piston head is disposed within the cylindrical section. The piston head moves reciprocally within the cylindrical section.

A ball retention ring is coupled to the first end of the cylindrical section. A tapered section of the bat structure is couple to the second end of said cylindrical section. A handle is selectively attachable to, and detachable from, the tapered section using a mechanical connector that can be manually manipulated. A piston rod is coupled to both the handle and the piston head. The piston rod extends through the tapered section.

A ball can be set into the ball retaining ring with a friction fit. The piston head can then be advanced within the bat structure toward the ball. This creates a high pressure build-up that eventually displaces the ball and launches the ball into the air.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention toy assembly can be embodied in many ways, the embodiment illustrated shows the toy assembly being configured to hold three projectile balls. This embodiment is selected in order to set forth one of the best modes contemplated for the invention. The illustrated embodiment, however, is merely exemplary and should not be considered a limitation when interpreting the scope of the appended claims.

Figure 1:
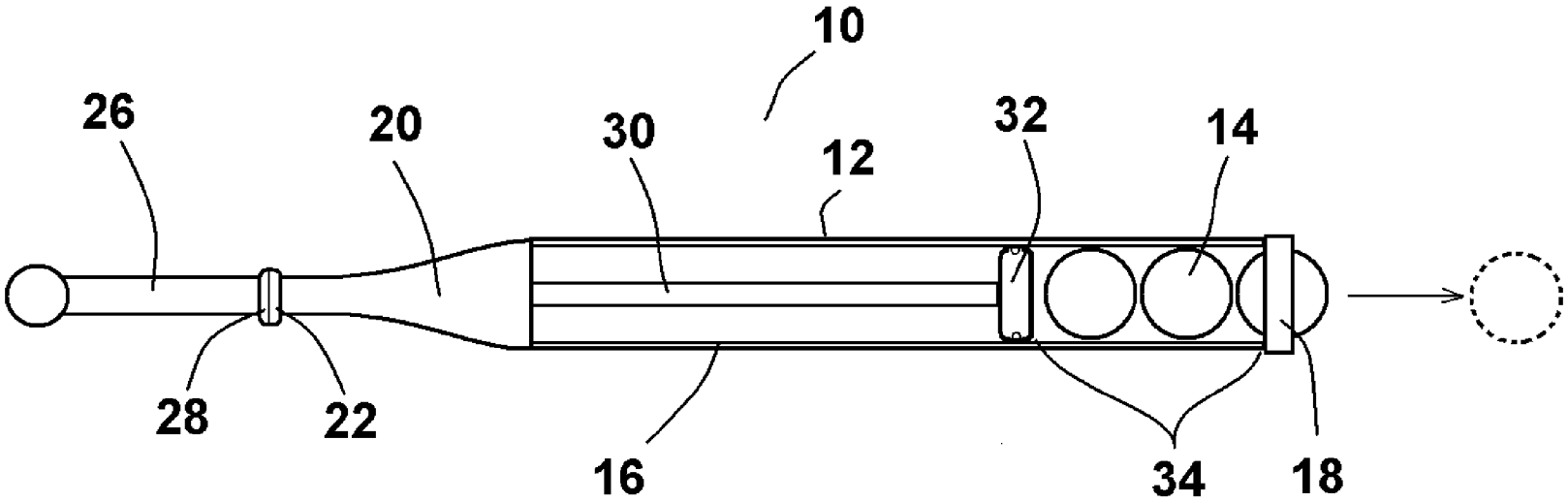
FIG. 1 is a side view of an exemplary embodiment of a toy assembly in accordance with the present invention.
Figure 2:
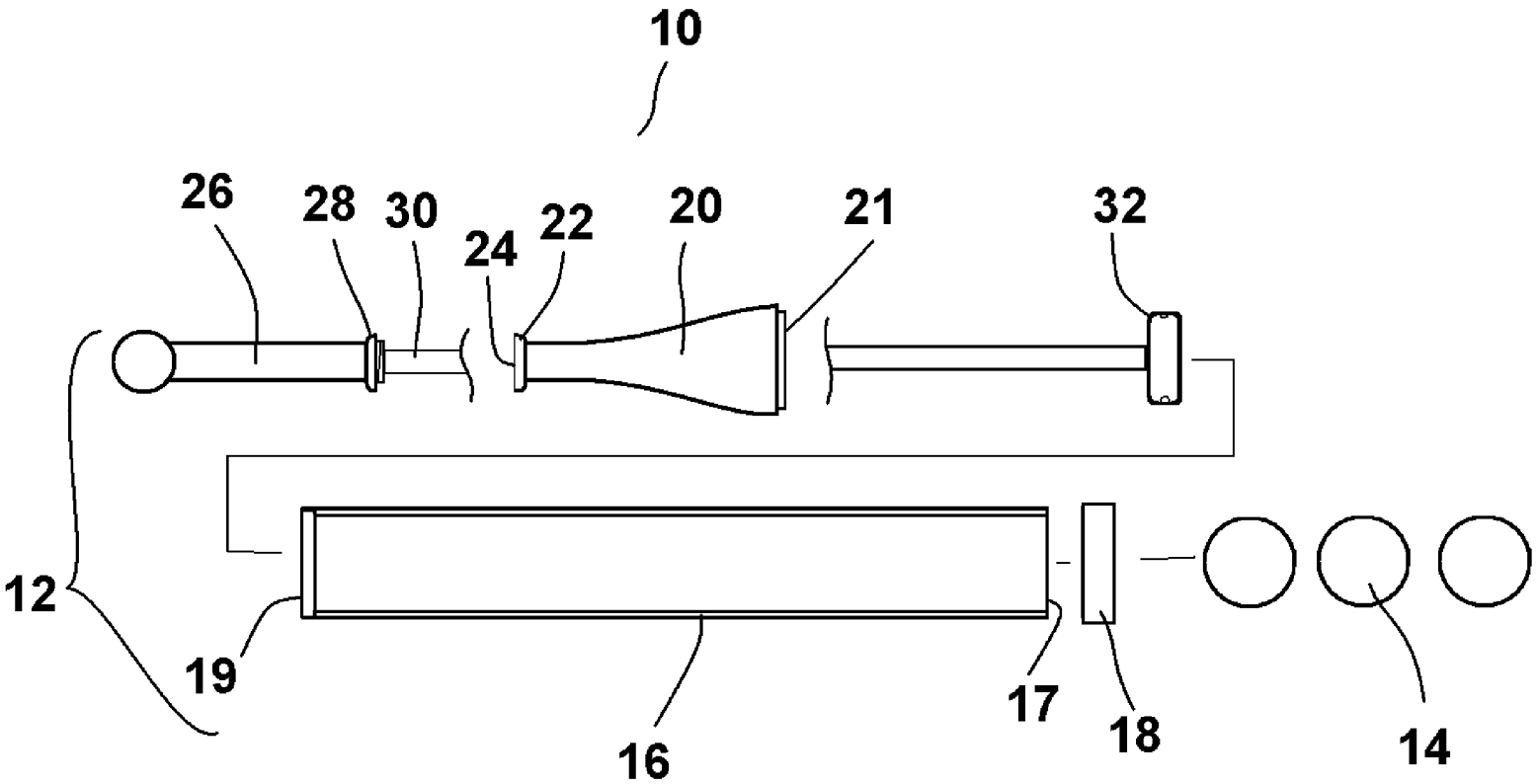
FIG. 2 is an exploded view of the embodiment of FIG. 1.
Figure 3:
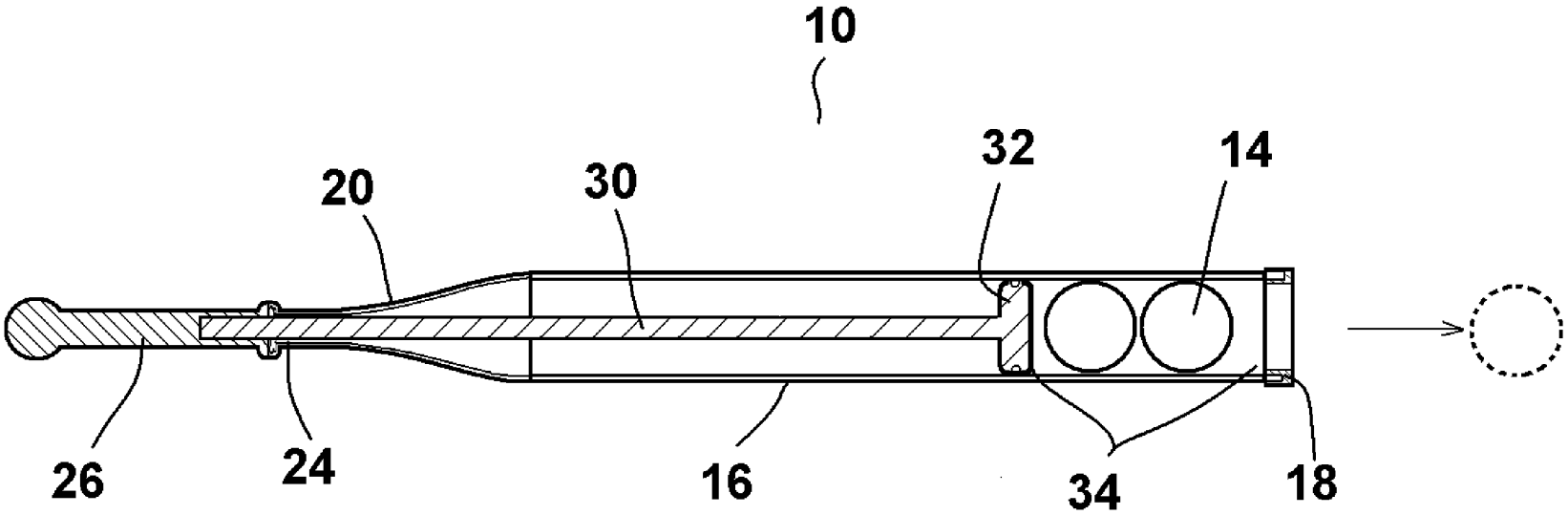
FIG. 3 is a cross-sectional view of the embodiment of FIG. 1.

Referring to FIG. 1 in conjunction with both FIG. 2 and FIG. 3, the toy assembly 10 is shown. The toy assembly 10 includes a bat structure 12 and one or more projectile balls 14. The bat structure 12 is shaped in the form of a baseball bat. The bat structure 12 can be used to interact with the projectile balls 14 in two distinct ways. First, the bat structure 12 can be used to bat the projectile balls 14 in a traditional manner of a baseball bat. Second, the projectile balls 14 can be loaded into the bat structure 12 and launched as a flying projectile using pneumatic force.

The projectile balls 14 used in the toy assembly 10 have a set diameter. The projectile balls 14 are preferably made from a soft foam or other lightweight material so that they cannot cause harm when launched as a projectile.

The bat structure 12 has a cylindrical section 16. The cylindrical section 16 has a constant inside diameter that is larger than the diameter of the projectile balls 14. As such, the projectile balls 14 are free to roll within the cylindrical section 16. The first end 17 of the cylindrical section 16 is capped with a ball retention ring 18. The ball retention ring 18 is an annular structure that has an inside diameter just smaller than the diameter of the projectile balls 14. As such, the projectile balls 14 can pass through the ball retention ring 18. However, the projectile balls 14 must be slightly deformed to do so. The ball retention ring 18 is wide enough so that a projectile ball 14 can be retained within the ball retention ring 18 with a friction fit. When a projectile ball 14 is retained within the ball retention ring 18, the projectile ball 14 is slightly deformed and creates a nearly airtight seal between the projectile ball 14 and the ball retention ring 18.

The opposite second end 19 of the cylindrical section 16 interconnects with a tapered section 20 of the bat structure 12. The tapered section 20 tapers between a large end 21 and a small end 22, creating the neck of the bat structure 12. The large end 21 of the tapered section 20 has the same outside diameter as does the cylindrical section 16 so that it can connect to the cylindrical section 16 without creating a bump or ledge. This provides the bay structure 12 with a smooth exterior.

The tapered section 20 is hollow. The small end 22 of the tapered section 20 terminates with an opening 24 that is threaded.

A handle 26 is provided. The handle 26 has a distal end 28 that is also threaded. The threading on the distal end 28 of the handle is sized and shaped to engage the threaded opening 24 at the small end 22 of the tapered section 20. In this manner, the handle 26 can be mechanically attached to the small end 22 of the tapered section 20 by screwing the handle 26 onto the threaded opening 24 of the tapered section 20.

A piston rod 30 is attached to the handle 26. The piston rod 30 extends from the distal end 28 of the handle 26. The piston rod 30 is sized to pass through the threaded opening 24 at the small end 22 of the tapered section 20. Consequently, when the handle 26 is mechanically affixed to the tapered section 20, the piston rod 30 passes through the tapered section 20 and into the cylindrical section 16.

The piston rod 30 terminates with a piston head 32 within the cylindrical section 16. The piston head 32 creates an airtight seal against the interior diameter of the cylindrical section 16. It will therefore be understood that when the handle 26 is moved relative the tapered section 20, the piston rod 30 moves inside the cylindrical section 16. The piston rod 30 moves the piston head 32 inside the cylindrical section 16, therein either drawing air into the cylindrical section 16 or displacing air out of the cylindrical section 16 through the ball retention ring 18.

As is shown in FIG. 1, when the handle 26 is fully mechanically engaged with the tapered section 20, the piston head 32 is still distant from the ball retention ring 18. As a result, a reserve area 34 is disposed between the piston head 32 and the ball retention ring 18. The size of the reserve area 34 depends upon the size and number of projectile balls 14 packaged with the bat structure 12 as part of the toy assembly 10. In the shown embodiment, three projectile balls 14 are packaged as part of the toy assembly 10. The reserve area 34 is therefore sized to hold two and one-half of the projectile balls 14. In this manner, two of the projectile balls 14 can be held within the reserve area 34 while the third projectile ball 14 is ready to be launched being both half in the reserve area 34 and centered in the ball retention ring 18.

To utilize the bat structure 12 as a traditional bat, the handle 26 is tightly affixed to the tapered section 20. The bat structure 12 can then be used as a toy baseball bat. The projectile balls 14 may or may not be present within the reserve area 34 of the cylindrical section 16.

If a projectile ball 14 is located within the ball retention ring 18, then it is possible to dislodge the projectile ball 14 from the ball retention ring 18 by swinging the bat structure 12 particularly fast. In this manner, a projectile ball 14 can be displaced from the ball retention ring 18 and launched using centrifugal force.

Figure 4:
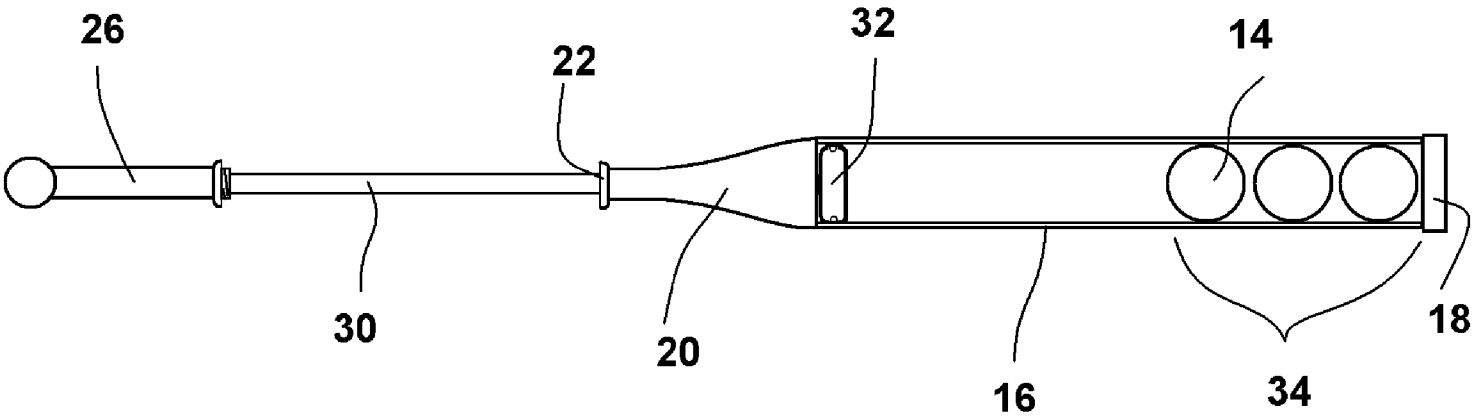
FIG. 4 is a side view of the exemplary embodiment with the toy assembly shown with the piston head fully retracted.

As has been previously mentioned, the bat structure 12 can also be configured as a pneumatic launcher. Referring to FIG. 4, it can be seen that the handle 26 can be separated from the small end 22 of the tapered section 20 by turning the handle 26 and undoing the threaded connection. The handle 26 remains affixed to the piston rod 30. By manually manipulating the handle 26, the piston rod 30 can be moved back and forth through the tapered section 20. This causes the piston head 32 to move reciprocally within the cylindrical section 16 between a retracted position and an extended position. The fully retracted position is shown in FIG. 4. The fully extended position is shown in FIG. 1.

To launch a ball pneumatically, the handle 26 is pulled and the piston head 32 is drawn back to its fully retracted position. Air behind the piston head 32 exits around the piston rod 30 through the small end 22 of the tapered section 20. A projectile ball 14 is then loaded into the ball retention ring 18. This can be done in one of two ways. The projectile ball 14 can be loaded into the ball retention ring 18 manually by inserting the projectile ball 14 into the ball retention ring 18 from outside the bat structure 12. Alternatively, provided a projectile ball 14 is present within the reserve area 34, a projectile ball 14 from the reserve area 34 can be automatically loaded into the ball retention ring 18 using pneumatic pressure.

To load a projectile ball 14 into the ball retention ring 18 using pneumatic pressure, the bat structure 12 is held vertically so that the ball retention ring 18 faces downwardly. In this position, gravity causes the projectile ball 14 to rest against the ball retention ring 18. While maintaining this position, the handle 26 is advanced a small distance. This causes the piston head 32 to advance toward the projectile ball 14 a corresponding small distance. The pressure inside the cylindrical section 16 increases and the projectile ball 14 is driven into a set position within the ball retention ring 18.

Once a projectile ball 14 is loaded into the ball retention ring 18, it can be launched pneumatically. To launch the projectile ball 14, the piston head 32 is rapidly moved from its fully retracted position to its fully extended position. This is accomplished by manually advancing the handle 26 toward the tapered section 20. As the piston head 32 advances, the pressure within the cylindrical section 16 increases. As the piston head 32 approaches its fully extended position, the pressure within the cylindrical section 16 is sufficient to displace the projectile ball 14 out of the ball retention ring 18. This creates a rapid discharge of the air pressure behind the projectile ball 14. The projectile ball 14 is therefore launched with significant velocity away from the bat structure 12.

It will be understood that the embodiment of the present invention that is illustrated and described is merely exemplary and that a person skilled in the art can make many variations to that embodiment. For instance, the dimensions of the bat structure, the size of the balls, and the shape of components, like the handle, are all a matter of design choice. All such embodiments are intended to be included within the scope of the present invention as defined by the claims.

What is claimed is:

1. A toy assembly, comprising:

a cylindrical section having a first end, a second end and an interior;

a piston head disposed within said cylindrical section that can move reciprocally within said cylindrical section, wherein said piston head creates an airtight seal against said interior of said cylindrical section;

a ball retention ring coupled to said first end of said cylindrical section;

a tapered section coupled to said second end of said cylindrical section;

a handle that is selectively attachable to, and detachable from, said tapered section with a mechanical connector; and a piston rod that extends from said handle to said piston head, wherein said piston rod extends through said tapered section, and wherein movement of said handle relative to said cylindrical section is transferred to said piston head within said cylindrical section by said piston rod.

2. The toy assembly according to claim 1, wherein said ball retention ring is sized to retain a ball of a first diameter.

3. The toy assembly according to claim 2, wherein a reserve area exists within said cylindrical section between said ball retention ring and said piston head when said handle is attached to said tapered section with said mechanical connector.

4. The toy according to claim 3, wherein said reserve area is at least one and a half times larger than said first diameter.

5. The toy assembly according to claim 1, wherein said cylindrical section is transparent.

6. The toy assembly according to claim 1, wherein said mechanical connector is a threaded interconnection.

7. A toy assembly, comprising:

a ball of a first diameter;

a bat structure having a handle, a cylindrical section and a ball retention ring connected to said cylindrical section, wherein said cylindrical section has an interior and is wide enough to receive said ball therein, said ball retention ring is sized to receive and retain said ball with a friction fit, and said handle includes a mechanical connector that enables said handle to be selectively attached to, and detached from, a remainder of said bat structure;

a piston head disposed within said cylindrical section, wherein said piston head creates an airtight seal against said interior of said cylindrical section;

a piston rod extending from said handle to said piston head, wherein said piston rod transfers movement of said handle relative said cylindrical section to said piston head within said cylindrical section.

8. The toy assembly according to claim 7, wherein a reserve area remains in said cylindrical section between said piston head and said ball retention ring that is large enough to hold said ball when said piston head is fully advanced into said cylindrical section by said handle and said piston rod.

9. The toy assembly according to claim 7, wherein said bat structure further includes a tapered section interposed between said cylindrical section and said handle.

10. The toy assembly according to claim 7, wherein said cylindrical section is transparent.

11. The toy assembly according to claim 7, wherein said mechanical connector is a threaded interconnection.

12. A toy assembly, comprising:

a baseball bat structure having a hollow cylindrical section and a handle, wherein said handle is selectively detachable from said baseball bat structure;

a piston head disposed within said hollow cylindrical section, wherein said piston head creates an airtight seal against said hollow cylindrical section;

a piston rod that extends from said handle to said piston head, wherein reciprocal movement of said handle relative to said hollow cylindrical section causes reciprocal movement of said piston head within said hollow cylindrical section; and a retention ring disposed at one end of said baseball bat structure, wherein reciprocal movement of said piston head displaces air through said retention ring.

13. The toy assembly according to claim 12, wherein said baseball bat structure further includes a tapered section interposed between said cylindrical section and said handle.

14. The toy assembly according to claim 12, wherein said cylindrical section is transparent.

15. The toy assembly according to claim 12, wherein said handle selectively attaches to said baseball bat structure with a threaded connection.

* * * * *